US009367042B2

(12) United States Patent
Oetken et al.

(10) Patent No.: US 9,367,042 B2
(45) Date of Patent: Jun. 14, 2016

(54) MACHINE ALERT WHEN STOPPING ON HOT ASPHALT

(71) Applicant: Caterpillar Inc., Peoria, IL (US)

(72) Inventors: Nicholas Alan Oetken, Brooklyn Park, MN (US); John Marsolek, Watertown, MN (US); Travis Ohlgren, Minneapolis, MN (US)

(73) Assignee: Caterpillar Paving Products, Inc., Brooklyn Park, MN (US)

( * ) Notice: Subject to any disclaimer, the term of this patent is extended or adjusted under 35 U.S.C. 154(b) by 59 days.

(21) Appl. No.: 14/520,041

(22) Filed: Oct. 21, 2014

(65) Prior Publication Data

US 2016/0109858 A1 Apr. 21, 2016

(51) Int. Cl.

| | |
|---|---|
| ***E01C 19/26*** | (2006.01) |
| ***E01C 19/00*** | (2006.01) |
| ***G04F 3/06*** | (2006.01) |
| ***E01C 19/28*** | (2006.01) |
| ***G04G 13/02*** | (2006.01) |
| ***G08B 21/18*** | (2006.01) |

(52) U.S. Cl.

CPC ..... *G04F 3/06* (2013.01); *E01C 19/004* (2013.01); *E01C 19/26* (2013.01); *E01C 19/288* (2013.01); *G04G 13/021* (2013.01); *G08B 21/182* (2013.01)

(58) Field of Classification Search

CPC ..... E01C 19/004; E01C 19/26; E01C 19/288; G04F 3/06; G04G 13/02; G08B 21/182

See application file for complete search history.

(56) References Cited

U.S. PATENT DOCUMENTS

| | | | | |
|---|---|---|---|---|
| 5,356,238 | A * | 10/1994 | Musil | E01C 19/008 404/101 |
| 5,942,679 | A | 8/1999 | Sandstrom | |
| 6,236,923 | B1 * | 5/2001 | Corcoran | B60C 23/00 340/442 |
| 6,749,364 | B1 * | 6/2004 | Baker | E01C 19/288 404/118 |
| 7,873,492 | B2 | 1/2011 | Ackermann | |
| 8,382,395 | B2 | 2/2013 | Glee et al. | |
| 2005/0053447 | A1 * | 3/2005 | Bucher | E01C 19/004 411/470 |
| 2009/0142133 | A1 * | 6/2009 | Glee | E01C 19/004 404/75 |
| 2009/0317186 | A1 * | 12/2009 | Glee | E01C 19/004 404/75 |

FOREIGN PATENT DOCUMENTS

| | | | |
|---|---|---|---|
| CN | 103290762 | A | 9/2013 |
| CN | 203700917 | U | 7/2014 |
| WO | 0070150 | A1 | 11/2000 |
| WO | 2010027978 | A1 | 3/2010 |

* cited by examiner

*Primary Examiner* — Abigail A Risic

(74) *Attorney, Agent, or Firm* — Miller, Matthias & Hull LLP

(57) ABSTRACT

An alert system in equipment used in an asphalt paving environment, such as a compactor, signals an operator when the equipment is stopped on hot asphalt, potentially over-compacting the area where the equipment is located. The alert system includes a surface temperature sensor so that the alert is only activated when there is a risk of over-compaction because the asphalt is still above a threshold temperature. The alert system may also include a timer so that the operator is not signaled during routine stopping associated with changing direction during compacting operations.

20 Claims, 3 Drawing Sheets

MACHINE ALERT WHEN STOPPING ON HOT ASPHALT

TECHNICAL FIELD

The present disclosure relates to asphalt paving and particularly to an alert system for notifying when a paving compactor or other equipment is stopped on hot asphalt.

BACKGROUND

Asphalt paving involves depositing a mat of paving material such as hot asphalt on a bed and then compacting the asphalt to a uniform thickness and consistency. Compactors use different configurations for the compacting process. Some compactors use a steel drum with vibrators. Other compactors use separate wheels, while others use a combination of separate wheels and drums. When a compactor sits idle on an area of recently placed hot asphalt, the drum or wheels may sink into the asphalt and over-compact those areas under the drum or wheels. Once over-compacted, the dip formed in those areas is virtually unrepairable and the deformation compared to the remaining uniform asphalt mat will remain indefinitely.

U.S. Pat. No. 5,942,679 (the '679 patent) discloses a system for monitoring environmental and machine conditions to create an index related to the state of compaction of an area where asphalt has been deposited. The index is displayed to an operator and represents a total amount of compaction that has been made on each area of the work site. The '679 patent fails to disclose an alert system that notifies an operator when a compactor is stopped on an area of asphalt that is still hot enough to result in over-compaction of that area.

SUMMARY OF THE DISCLOSURE

In one aspect of the current disclosure, an alert system for use in a compactor for an asphalt paving operation includes a speed sensor, a pavement temperature sensor, and an operator alert device. The operator alert device is configured to activate an alert to an operator when a command is received. The alert system may also include a controller determines, via the speed sensor, that the compactor is stopped, and also determines, via the pavement temperature sensor, that a pavement temperature proximate the compactor is above a threshold temperature. When both conditions are true, the controller issues the command to activate the operator alert device. The alert device signals the operator that the compactor may need to be moved to avoid over-compacting the area where the machine is resting.

In another aspect of the current disclosure, a method of setting an alert in equipment used in a paving application includes determining that the equipment has come to a full stop, determining that a surface proximate to the equipment is above a threshold temperature and starting a timer. When the timer reaches a preset time and the equipment has remained at the full stop for the entire preset time, the alert is activated, notifying the operator that the equipment should be moved.

In yet another aspect of the current disclosure, a system for activating an alarm in paving equipment includes a timer and a temperature sensor that conveys a temperature of a surface proximate to the paving equipment. The alarm may be configured to alert an operator of the paving equipment of a condition responsive to a signal from a controller. The controller may be coupled to the timer, the temperature sensor, and the alarm, and configured receive a signal indicating the paving equipment is stopped and to start the timer when both the paving equipment is stopped and a temperature of surface proximate to the paving equipment is above a threshold temperature. The controller may be further configured so that when the timer reaches a preset time, the controller activates the alarm.

DETAILED DESCRIPTION

A compactor is a machine that compresses hot asphalt into a dense mat intended for use in applications from roadways to bicycle paths. Some compactors use steel drums with vibrators while others use rows of pneumatic tires, while yet others both a drum and a row of pneumatic wheels. Compactors can weigh over 10 tons and because of the relatively small contact area of, for example, two steel drums a compactor can provide very high pound per square inch pressures.

When left motionless for even a few minutes on a hot asphalt surface, a compactor can over-compact the area on which it is sitting and cause virtually irreparably damage in the form of a dip in an otherwise uniform surface.

Figure 1:
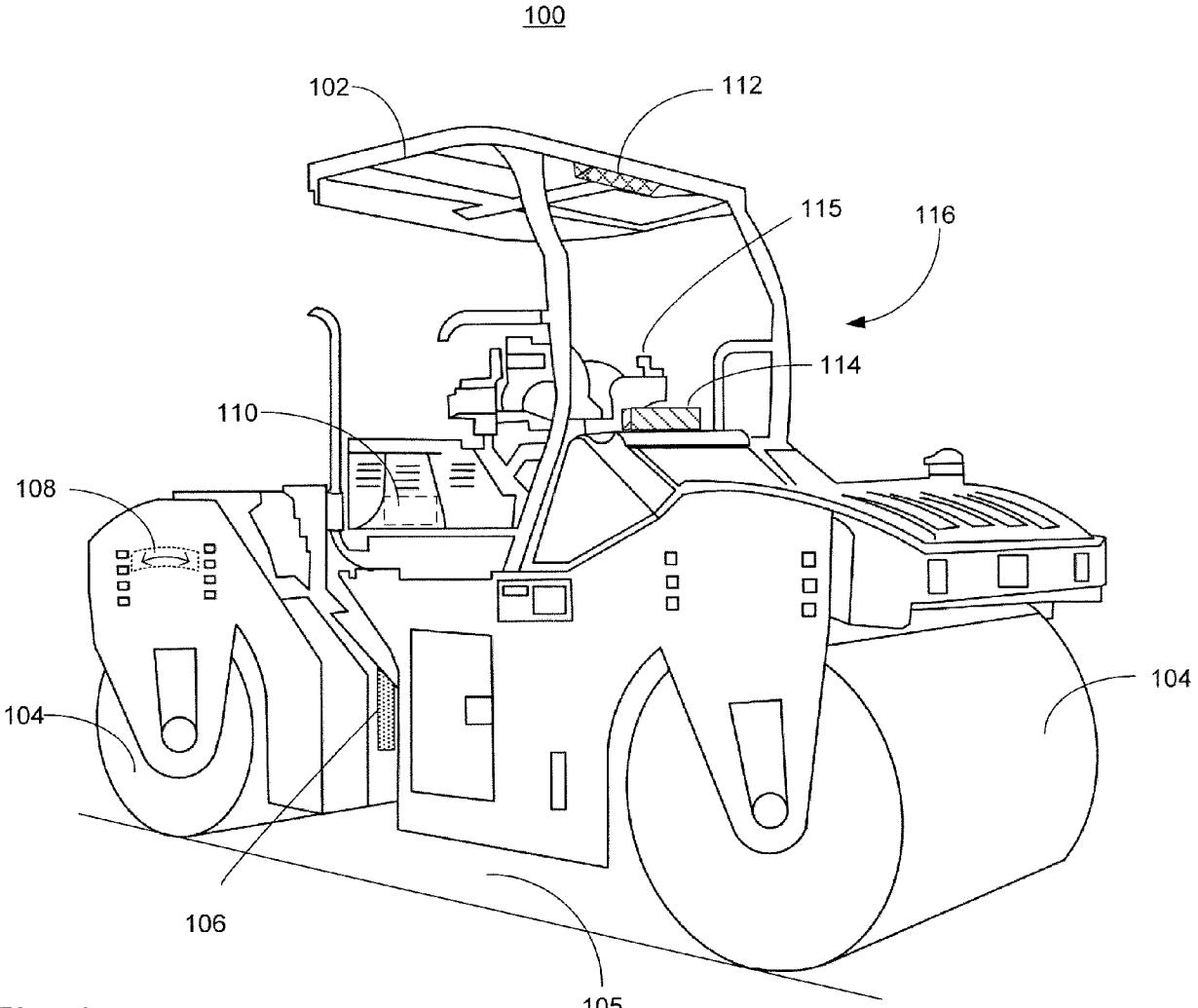
FIG. 1 is a perspective view of a compactor.

FIG. 1 illustrates an exemplary compactor 100. The compactor 100 may include a cab 102 or sunshade and drums 104. Further details of an exemplary compactor 100, such as vibrators, steering mechanisms, propulsion units, rollover protection systems, etc. are not disclosed herein but are known in the industry.

The compactor 100 also includes a temperature sensor 106, such as an infrared temperature sensor that is capable of remotely reading a temperature of a surface 105 proximate to the compactor 100 at which the temperature sensor 106 is directed. In an exemplary embodiment, the temperature sensor 106 may be directed to a location between the drums 104. In other embodiments, one or more temperature sensors may be directed in front of or behind the drums 104 and may be instead of or in addition to the illustrated temperature sensor 106 directed between the drums 104.

Compactor 100 may also include a speed sensor 108 that measures and reports speed of the compactor in either direction. In some embodiments the speed sensor 108 may measure rotation of a drum 104 or may be coupled to a transmission (not depicted) that calculates compactor speed from an engine RPM and transmission gear ratio. In other embodiments, speed may be provided by a Global Positioning System (GPS) device (not depicted). In some embodiments, the speed sensor 108 may not be exclusively dedicated to providing speed for use in alerting an operator when stopping on hot asphalt. For example, the speed sensor 108 may be primarily used simply to indicate a speed of the machine to an operator in a conventional manner.

In another embodiment, speed may not be measured directly but may be derived from a control lever 115 used by an operator to select speed and direction. In this embodiment, the control lever 115 is pushed forward or backward to select direction and the distance that the control lever 115 is moved from a center position determines the speed. When the control lever is in the neutral position, no power is applied to drive the compactor 100. An assumption can be made that when the control lever 115 is in the neutral position that the compactor 100 is stopped or soon will be. Evaluation of the control lever position can be used to derive when the compactor 100 is stopped.

The compactor 100 may optionally include an occupancy sensor 114 that may be used to determine that an operator is present in the cab 102. The use of the optional occupancy sensor 114 is discussed in more detail below.

The temperature sensor 106, speed sensor 108 or control lever position sensor and occupancy sensor 114 may be coupled to a controller 110. The controller 110 is discussed in more detail below with respect to FIG. 2. The compactor 100 may also include an operator alert device 112 which may be directly or indirectly activated by the controller 110 responsive to certain conditions also discussed in more detail below. The operator alert device 112 may include a speaker, siren, indicator light, or other device used separately or in combination so that when activated there is a very high likelihood that an operator will notice that the alert device 112 has been activated. In other embodiments, the operator alert device 112 may be part of a console display or other user interface already present in the compactor 100. The operator alert device 112 may also include a sign or an icon indicating that an undesirable condition may be present and/or simply that the compactor 100 should be moved.

The temperature sensor 106, the speed sensor 108, the operator alert device 112, optionally, the occupancy sensor 114, and at least those functions of the controller 110 associated with analyzing conditions and determining when to activate the operator alert device 112 may form an alert system 116 for use in the compactor 100.

Figure 2:
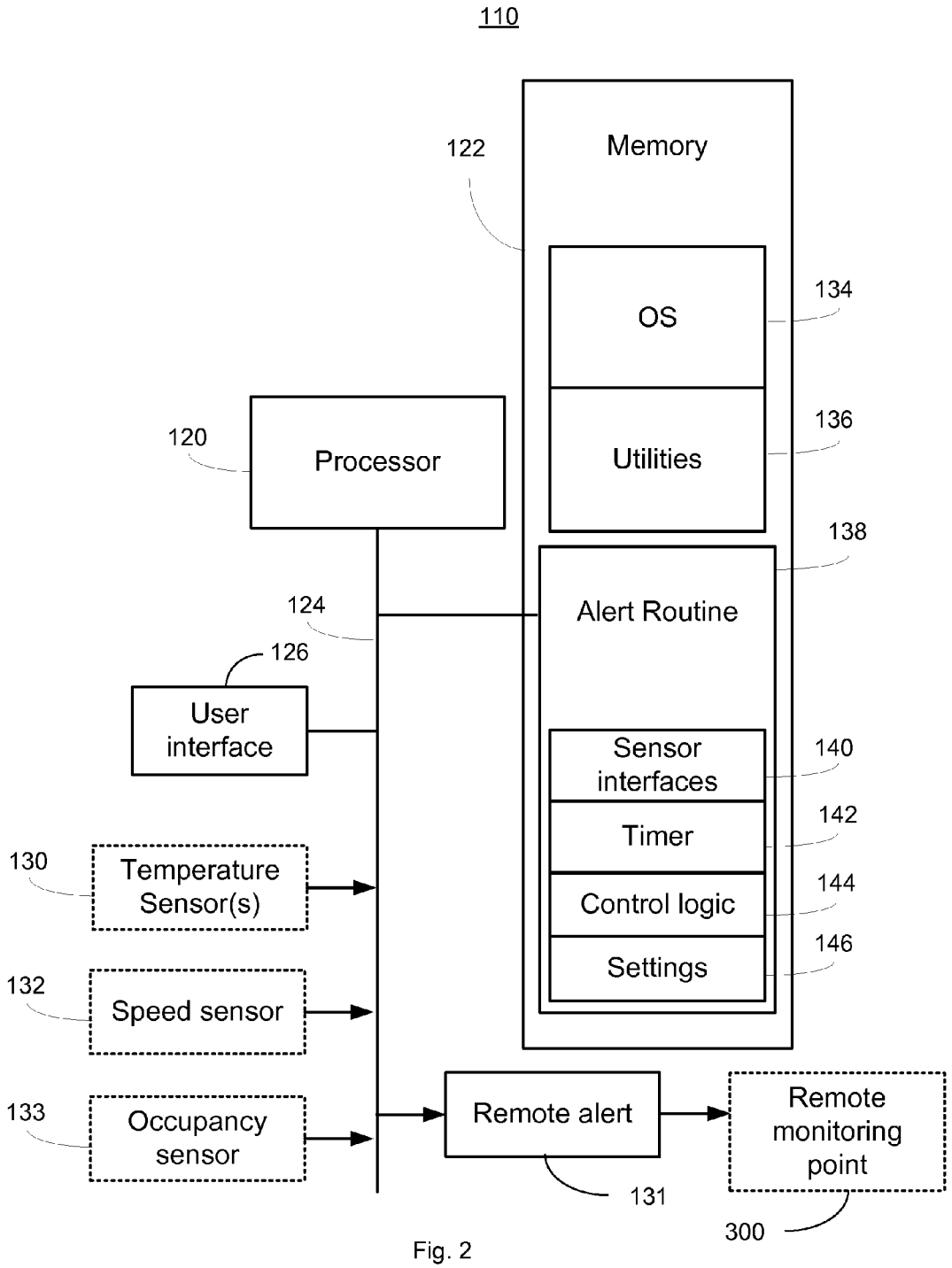
FIG. 2 is a block diagram of an exemplary controller for use in the compactor of FIG. 1.

FIG. 2 is a block diagram of an exemplary embodiment of a controller 110. The controller 110 may include a processor 120 and a memory 122 coupled by a data bus 124. The controller 110 may also include or be connected to a user interface 126 that may include a display, a touchscreen, a keyboard, a pointing device, or a speaker.

Controller 110 may also include an input 130 that interfaces with the temperature sensor 106 and an input 132 that interfaces with the speed sensor 108. Optionally, an occupancy sensor input 133 may be used in conjunction with other cab electronics to allow determination if an operator is in the cab 102. A remote alert interface 131 may be optionally used to relay the alert signal related to stopping on a hot surface to a remote monitoring point 300, such as a supervisor, a remote management facility, or a paving machine operating near the compactor 100. The remote alert interface 131 may be a wireless interface that supports one or more local or wide area communication types, such as IEEE 802.11x (WiFi) or a cellular network protocol such as 3G, or other data communication path.

The memory 122 may include an operating system 134 and utilities 136 that provide, for example, diagnostics and error recovery routines, as well as low-level communication and interface support functions. An alert routine 138 may include modules that support various functions associated with providing the alert to an operator. These modules may include sensor interfaces 140 that communicate with the temperature, speed, and occupancy sensors via their respective inputs 130, 132, 133 and provide values for those parameters to a control logic module 144. As discussed above, the speed sensor input 132 may either receive a signal from a device such as speed sensor 108 that measures actual speed or may receive a signal from a device such as a control lever 115 that controls speed.

The alert routine 138 may also include a module that implements a timer 142 and the control logic module 144 that evaluates data received from the temperature sensor 106, speed sensor 108, and occupancy sensor 114 and determines when to activate the operator alert device 112. A settings module 146 may store various information that can be altered according to local conditions including ambient temperature, a threshold temperature of the asphalt, or a period of time counted by the timer 142. An additional setting may be a type of asphalt, that is, a formulation of chemicals and aggregate being compacted. This setting may be used to adjust either the threshold temperature of the asphalt or the period of time for the timer 142 based on characteristics of the mix. For example, a stiffer mix being used on a cool day may tolerate a longer standing time before damage to the asphalt occurs, therefore, the time period of the timer 142 may be increased over a nominal value. While the settings module 146 may allow direct input of the time period of the timer 142, there may be a maximum allowable time, such as 8-10 seconds, so that an operator does not disable the system by setting a very long standing time.

The settings module 146 may also store prompts for the operator or site manager that guide him or her through the process of selecting asphalt types and temperature settings by prompting for the various selections from a drop-down list. When information is not known, the settings module 146 may be programmed to select default values. In some instances, information may be relayed from the paving machine (not depicted), such as asphalt temperatures. The settings module 146 may also contain an algorithm or look-up table that evaluates the various inputs and selects an adjustment to the time period of the timer 142. For example, each known pavement type may have a plus or minus adjustment factor. Similarly, temperatures above and below a pre-determined nominal temperature may also have a plus or minus adjustment factor.

INDUSTRIAL APPLICABILITY

An alert system 116 for compactors, or other vehicles that may park on hot asphalt, benefits both the contractors constructing the surface and the customers taking delivery of the finished job. Permanent dips in an asphalt surface can collect rain and cause premature eroding of the binder allowing cracks to form. Dips in the surface of roadways may cause vehicle wheels to bounce and cause instability. By alerting an operator when the conditions are present for unintended overcompacting, unintentional creation of such dips of this nature can be avoided.

Figure 3:
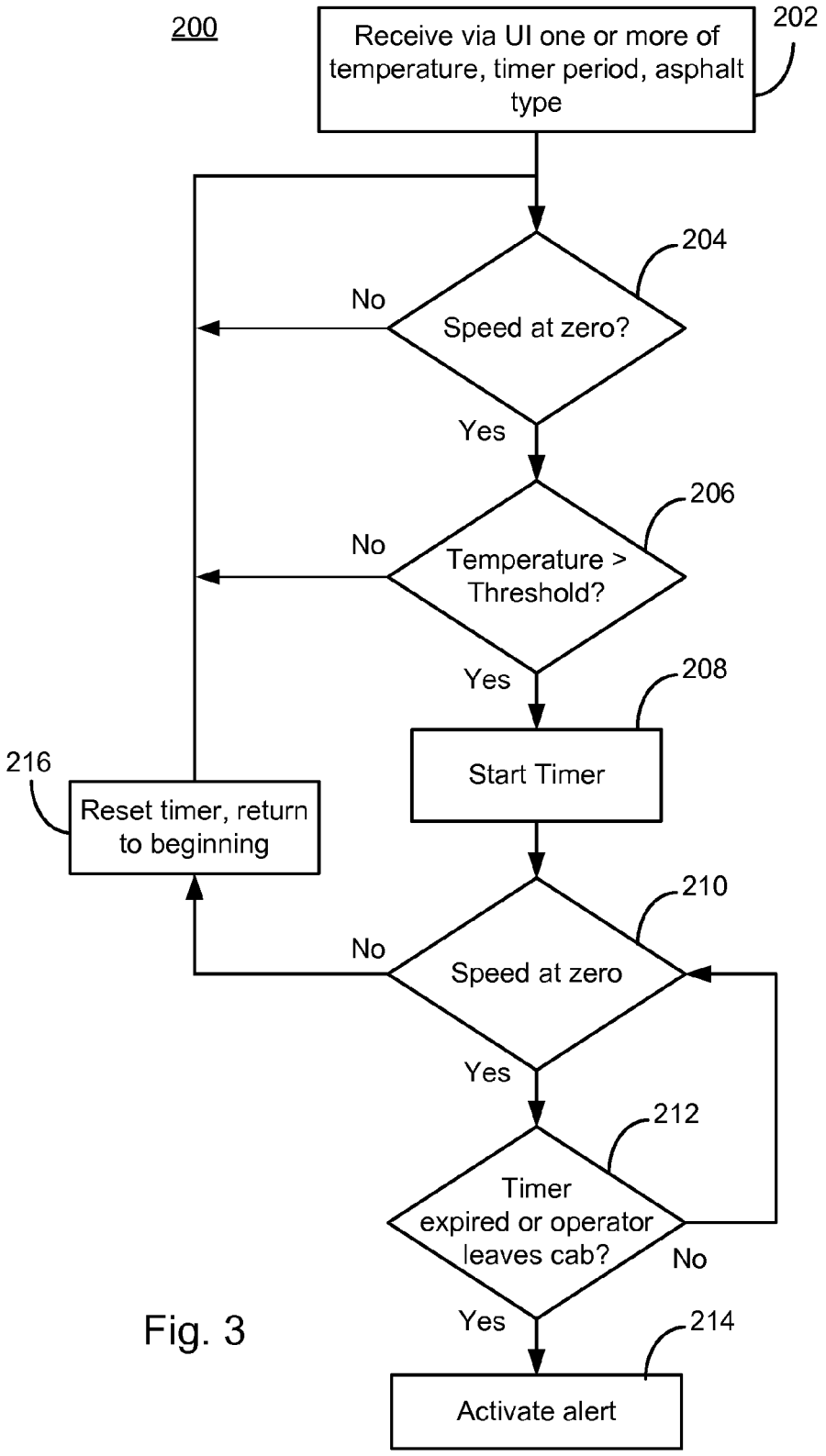
FIG. 3 is a flowchart of an exemplary method of setting an alert in equipment used in a paving environment.

FIG. 3 is a flowchart of a method 200 of setting an alert in equipment used in a paving application. At a block 202, information used to determine characteristics for setting the operator alert device 112 may be received via a user interface 126. The information may include a threshold temperature of the asphalt, a timer period, a type of asphalt, a thickness of the asphalt mat, vehicle weight, etc.

In some embodiments, default values may be installed at the time of manufacture or initial installation of the controller 110 into the compactor 100. Each of the settings may affect corresponding characteristics of the evaluation process, as discussed more below.

At block 204, a speed of the compactor 100 is evaluated to determine if the speed is zero or so low so that for all purposes the compactor is stopped. As discussed above, the speed of the compactor 100 may be directly measured via a speed sensor 108 or GPS, or the speed may be derived by monitoring the position of a speed/direction control lever. For some formulations of asphalt that are particularly soft, and/or when the ambient temperature is very high, a minimum speed threshold may be set to be the equivalent of stopped, for example, speeds less than 0.5 mile per hour. When the speed is at zero or below a threshold speed, the 'yes' branch may be taken from block 204 to block 206. When the speed is above zero or above the threshold speed, the 'no' branch is taken and the loop continues at the entry to block 204.

At block 206, a temperature of the asphalt may be compared to a threshold temperature. In an embodiment, a nominal threshold temperature may be in a temperature in a range of 150° F. to 170° Fahrenheit (° F.). In another embodiment, the range may be from 158° F. to 162° F. Variations from the nominal threshold temperature and these ranges may be made based on asphalt formulation and ambient temperature. For example, a softer formulation may use a lower threshold temperature. In another example, when the asphalt layer is thicker, it may be more susceptible to over-compacting because of higher temperatures below the surface, so the threshold temperature may be lowered compared to the nominal threshold temperature. When the temperature of the asphalt is above the threshold temperature, the 'yes' branch may be taken from block 206 to block 208. When the temperature of the asphalt is below the threshold temperature, the 'no' branch may be taken and the loop continued at the entry point to block 204.

While the illustrated embodiment checks speed first, the checking of temperature and speed may be performed in the opposite sequence, that is, temperature first and then speed. Because both temperature and speed are, or can be, monitored continuously, an alternate implementation may simply use flags that are set when either condition is true and an interrupt can be activated when both flags are set. Other variations of determining when both conditions are true are also possible.

At block 208, a timer 142 may be started. A timer 142 may be used because an operator may change direction from forward to reverse many times during the compacting process. During that direction change, the speed will necessarily be at or near zero for some period of time. Also during a direction change, an operator may shift in his or her seat to be better able to see in the new direction of movement, which may prolong the time during which the compactor 100 is stopped. If an alert device 112 is set during these intentional transition periods, operators would quickly learn to ignore the alert. Therefore, the timer 142 may delay issuing the command to activate the alert for a time period, for example, in a preset time range of from 3 seconds to 5 seconds in most embodiments. Ambient temperature and asphalt formulation may also affect the actual value of the timer setting. For example, a high ambient temperature may make a newly laid asphalt surface more susceptible to over-compacting, therefore, the threshold temperature may be reduced, the timer setting may be reduced, or both. Similarly, a thick asphalt layer may be more susceptible to over-compacting, so the timer period may be adjusted lower so that the timer 142 times out more quickly.

At block 210, while the timer is running, the speed of the compactor 100 may be monitored. If the compactor 100 begins moving, the 'no' branch from block 210 may be taken to block 216. At block 216, the timer 142 may be reset and the method returns to block 204.

If the compactor 100 remains at rest, a loop with block 210 and block 212 may be entered that lasts until the timer 142 expires. When the timer 142 expires while the speed is still at zero or below a threshold speed, the 'yes' branch may be taken to block 214. As is known, the timer 142 may either count down from the time setting and expire when it reaches zero or may count up from zero to the time period. In other embodiments, the timer 142 may be a real time clock that expires when the real time clock reaches a calculated future time.

In some embodiments, block 212 may also include monitoring for the presence of an operator using an occupancy sensor 114 because if the operator leaves the cab 102 or operator station, waiting until the timer 142 expires may be cause the alert device 112 to be set after the operator is out of range and may not hear or see the signal. Therefore, sensing that an operator is no longer in the compactor 100 may override the timer aspect of block 212 and cause immediate execution at block 214. The occupancy sensor 114 may be or include a seat switch, a camera, a foot plate switch or other mechanism. Similarly, if the ignition is turned off, an assumption can be made that the operator is leaving the compactor 100 and execution immediately continued at block 214.

At block 214, the alert device 112 may be activated. The alert device 112 may be an audible horn or siren, an audible signal from a speaker mounted near an operator, a visual lamp or flasher, a visual signal on a dashboard or operator console, or a combination of any of these.

The value of alerting an operator that a machine is stopping on soft asphalt, denoted by a high surface temperature, is not limited to compactors but may also be useful for other worksite equipment that may encroach a newly paved area, such as dump trucks, pickup trucks, or supervisor vehicles, among others.

The system is not limited to alerting the operator. Information related to standing on hot pavement may also be communicated to a site supervisor, master location, or other remote monitoring point for either the site or the equipment operations company. The information may be useful for monitoring the jobsite and for developing operator training. In an embodiment, a signal may be relayed to the paving machine that the compactor 100 is stopped on hot asphalt.

What is claimed is:

1. An alert system for use in a compactor for an asphalt paving operation comprising:
- a speed sensor;
- a pavement temperature sensor;
- an operator alert device configured to activate an alert to an operator when a command is received; and
- a controller that:
  - determines, via the speed sensor, that the compactor is stopped;
  - determines, via the pavement temperature sensor, that a pavement temperature proximate the compactor is above a threshold temperature; and
  - issues the command that activates the operator alert device.

2. The alert system of claim 1, wherein the controller delays issuing the command to activate the operator alert device for a period of time after determining that the compactor is stopped.

3. The alert system of claim 2, further comprising a user interface configured to receive the threshold temperature.

4. The alert system of claim 3, wherein the user interface is further configured to receive a thickness of an asphalt layer for use in adjusting the threshold temperature.

5. The alert system of claim 3, wherein the user interface is further configured to receive a type of asphalt for use in adjusting one of the threshold temperature or the period of time of the delay.

6. The alert system of claim 2, further comprising an occupancy sensor that determines when the operator is outside a cab and overrides the delay for issuing the command to activate the operator alert device.

7. The alert system of claim 2, further comprising a user interface configured to receive the period of time.

8. The alert system of claim 2, wherein the period of time is in a range of 3 seconds to 5 seconds.

9. The alert system of claim 1, wherein the threshold temperature is in a range of 150 degrees Fahrenheit to 170 degrees Fahrenheit.

10. The alert system of claim 1, wherein the pavement temperature sensor is an infrared temperature sensor.

11. A method of setting an alert device in equipment used in a paving application comprising:

determining that the equipment has come to a full stop;

determining that a surface proximate to the equipment is above a threshold temperature;

starting a timer; and when the timer reaches a preset time and the equipment has remained at the full stop for the entire preset time, activating the alert device notifying an operator that the equipment should be moved.

12. The method of claim 11, wherein the equipment is an asphalt compactor.

13. The method of claim 11, further comprising:

communicating an alert signal to a remote monitoring point separate from the equipment.

14. The method of claim 11, further comprising:

receiving a command that sets the threshold temperature.

15. The method of claim 11, wherein determining that the surface proximate to the equipment is above the threshold temperature comprises receiving a temperature reading from an infrared temperature sensor.

16. The method of claim 11, further comprising:

receiving a signal that indicates a type of asphalt that makes up the surface; and adjusting one of the preset time or the threshold temperature based on the type of asphalt.

17. The method of claim 11, further comprising:

sensing that the operator is absent from an operator station of the equipment; and setting the alert device prior to the timer reaching the preset time.

18. A system for activating an alarm in paving equipment comprising:

a timer;

a temperature sensor that conveys a temperature of a surface of a mat of paving material proximate to the paving equipment;

the alarm configured to alert an operator of the paving equipment of a condition; and a controller coupled to the timer, the temperature sensor, and the alarm, the controller configured to:

receive a signal indicating the paving equipment is stopped;

start the timer when both the paving equipment is stopped and the temperature of the surface proximate to the paving equipment is above a threshold temperature; and when the timer reaches a preset time, activate the alarm.

19. The system of claim 18, wherein the preset time is in a range of 2 to 4 seconds and wherein the threshold temperature is in a range of 150 degrees Fahrenheit to 170 degrees Fahrenheit.

20. The system of claim 18 further comprising a user interface coupled to the controller configured to receive information related to at least one of the preset time, the threshold temperature, a formulation of the mat of paving material, and a thickness of the mat of paving material.

* * * * *